US007877901B2

(12) United States Patent
Calderone

(10) Patent No.: US 7,877,901 B2
(45) **Date of Patent: *Feb. 1, 2011**

(54) SLIP ON ATHLEISURE SHOE

(75) Inventor: David E. Calderone, Salem, MA (US)

(73) Assignee: Converse Inc., North Andover, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/604,291

(22) Filed: Oct. 22, 2009

(65) Prior Publication Data

US 2010/0037484 A1 Feb. 18, 2010

Related U.S. Application Data

(63) Continuation of application No. 12/421,550, filed on Apr. 9, 2009, now Pat. No. 7,624,518, which is a continuation of application No. 11/416,727, filed on May 3, 2006, now Pat. No. 7,552,547.

(51) Int. Cl.
*A43B 11/00* (2006.01)

(52) U.S. Cl. ..... 36/50.1; 36/51

(58) Field of Classification Search ..... 36/50.1, 36/51, 54

See application file for complete search history.

(56) References Cited

U.S. PATENT DOCUMENTS

| | | | | |
|---|---|---|---|---|
| 249,410 | A * | 11/1881 | Siegenthaler | 36/51 |
| 312,675 | A * | 2/1885 | Turner | 36/51 |
| 355,265 | A * | 12/1886 | Hayes | 36/51 |
| 536,345 | A * | 3/1895 | Harris | 36/51 |
| 1,028,598 | A * | 6/1912 | Papp | 36/54 |
| 3,037,303 | A | 6/1962 | Steuer | |
| 4,451,995 | A * | 6/1984 | Antonious | 36/51 |
| 6,904,706 | B2 * | 6/2005 | Jones et al. | 36/11.5 |
| 7,028,420 | B2 * | 4/2006 | Tonkel | 36/100 |
| 7,552,547 | B2 * | 6/2009 | Calderone | 36/50.1 |
| 2004/0003516 | A1 * | 1/2004 | Jacobs | 36/50.1 |
| 2005/0235525 | A1 * | 10/2005 | Jacobs | 36/50.1 |
| 2006/0168848 | A1 * | 8/2006 | Leoncini | 36/51 |

FOREIGN PATENT DOCUMENTS

| | | | |
|---|---|---|---|
| FR | 689540 | A | 9/1930 |
| GB | 2053657 | A | 2/1981 |
| WO | WO 99/17628 | A1 | 4/1999 |

OTHER PUBLICATIONS

Converse Spring 2001 Catalog p. 11.*

European Search Report for Application No. 07761672 dated Jun. 28, 2010.

* cited by examiner

*Primary Examiner*—Marie Patterson
(74) *Attorney, Agent, or Firm*—Shook Hardy & Bacon LLP

(57) ABSTRACT

A construction of an oxford type, lace up athleisure shoe enables the shoe to be slipped on the wearer's foot and held securely on the foot without the need for lacing on the shoe. This provides the shoe with the appearance of a lace up shoe that is worn without lacing.

16 Claims, 3 Drawing Sheets

SLIP ON ATHLEISURE SHOE

CROSS-REFERENCE TO RELATED APPLICATIONS

The present application is a continuation of U.S. patent application Ser. No. 12/421,550, filed Apr. 9, 2009, entitled "SLIP ON ATHLEISURE SHOE," which is a continuation of U.S. patent application Ser. No. 11/416,727, filed May 3, 2006, entitled "SLIP ON ATHLEISURE SHOE," the entire contents of each of which are incorporated herein by reference.

BACKGROUND OF THE INVENTION (1) Field of the Invention

The present invention pertains to a novel construction of an oxford type, lace up athleisure shoe. The novel construction of the shoe enables the shoe to be slipped on the wearer's foot and held securely on the foot without the need for lacing on the shoe. This provides the shoe with a unique and novel appearance of a lace up shoe that is worn without lacing.

(2) Description of the Related Art

The oxford lace up basketball shoe has been a very popular shoe for athletics, in particular basketball for many years. In addition to use for athletics, the shoe has also become very popular as a comfortable casual shoe, or athleisure shoe. This is particularly true of the oxford lace up basketball shoe that has an upper constructed of a breathable fabric, for example canvas.

Efforts to further improve the comfort of the shoe have lead to considering wearing the oxford lace up basketball shoe without lacing. However, although the shoe provides a comfortable fit around the wearer's foot even without lacing, wearing the shoe without lacing presents the problem of the shoe slipping off the wearer's foot during walking or running.

SUMMARY OF THE INVENTION

The present invention overcomes the problem of wearing oxford lace up basketball shoes without lacing. The invention provides a novel modification to this type of shoe that holds the shoe on the wearer's foot without the need for lacing. The athleisure shoe of the invention has the same construction as the popular oxford lace up basketball shoe, but without the lacing typically provided on the shoe. The lacing openings or eyelet openings on the shoe are left open, with there being no lacing on the shoe.

The shoe is modified with a band that is connected to the left side and right side of the shoe upper and extends across the shoe forefoot opening. The band is positioned just forward of the ankle opening of the upper to allow for easy insertion of the wearer's foot into the shoe. With the wearer's foot inserted in the shoe, the band extends across the wearer's forefoot, thereby securely holding the shoe on the foot. In the preferred embodiment, the band has at least one elastic portion that allows the band to be stretched. This allows the left side and right side of the shoe upper and the shoe tongue to be separated from each other to provide ample room for insertion of the foot into the shoe. The band is concealed by the upper and the tongue of the shoe so that the band is not visible when the shoe is worn.

The modification of the oxford lace up basketball shoe provided by the invention enables the athleisure shoe to be worn without lacing, and provides the shoe with the appearance of a standard oxford lace up basketball shoe being worn without lacing.

BRIEF DESCRIPTION OF THE DRAWINGS

Further features of the invention are set forth in the following detailed description of the preferred embodiment of the invention, and in the following drawing figures wherein.

DETAILED DESCRIPTION OF THE PREFERRED EMBODIMENT

Figure 1:
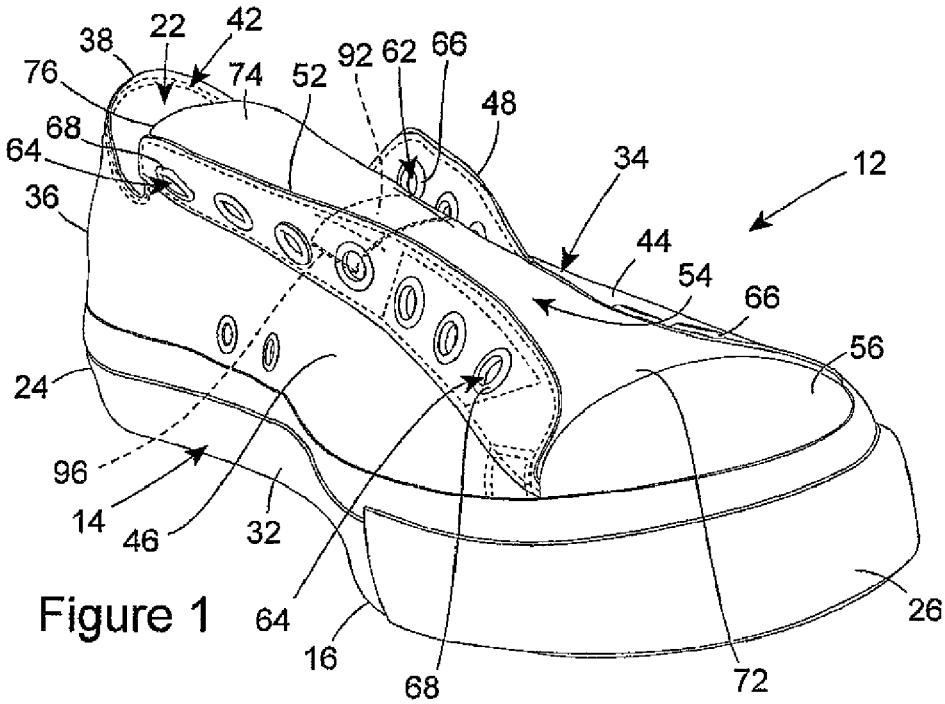
FIG. 1 is a perspective view of the front of a left shoe of the invention, with the right shoe of the invention having a construction that is a mirror image duplicate of the left shoe construction.

The slip on oxford athleisure shoe 12 of the present invention has the basic construction of an oxford lace up basketball shoe. The exception is that the novel construction of the shoe 12 enables the shoe to be securely worn on the foot without lacing, as will be explained. In the preferred embodiment of the shoe shown in the drawing figures, the shoe is an oxford basketball shoe. However, it should be understood that the novel concept of the invention could be employed on other types of lace up shoes that are desired to be worn without lacing and without altering the appearance of the lace up shoe. Because much of the construction of the shoe 12 of the invention is the same as that of a conventional oxford lace up shoe, the conventional features of the construction will be described generally.

The shoe 12 has a shoe sole 14 that is constructed of resilient materials that are typically employed in the constructions of the soles of athletic shoes. The sole 14 can be constructed with an outsole, a midsole, and an insert, as is typical. The shoe sole 14 has a bottom surface 16 that functions as the traction surface of the shoe, and an opposite top surface 18 in the interior 22 of the shoe. The size of the shoe 12 has a length that extends from a rear heel end 24 to a front toe end 26 of the sole, and the shoe 12 has a width between a left side 28 and a right side 32 of the shoe sole.

The shoe upper 34 is secured to the shoe sole 14 extending upwardly from the shoe sole top surface 18, as is conventional. The upper 34 is constructed of a flexible material, for example leather or fabric. The upper 34 is constructed with a heel portion 36 that extends around the shoe sole top surface 18 at the shoe sole heel end 24. The upper heel portion 36 extends upwardly from the shoe sole 18 to a collar edge 38 of the upper that defines an ankle opening 42 into the shoe interior 22.

From the heel portion 36, the upper has a left side 44 and a right side 46 that extend forwardly along the respective shoe sole left side 28 and shoe sole right side 32. The upper left side 44 extends upwardly from the shoe sole left side 28 to an upper left side edge 48. The upper right side 46 extends upwardly from the shoe sole right side 32 to an upper right side edge 52. As seen in the drawing figures, the upper left side edge 48 and the upper right side edge 52 extend forwardly from opposite sides of the upper collar edge 38 toward the front toe end 26 of the shoe sole. The length of the upper left side edge 48 and the upper right side edge 52 define a forefoot opening 54 in the shoe upper 34 that opens to the shoe interior 22.

The upper 34 is also constructed with a toe box 56 that extends around and across the shoe sole top surface 18 at the sole toe end 26. The toe box 56 is connected between the upper left side 44 and the upper right side 46 and encloses a portion of the shoe interior 22 adjacent the shoe sole toe end 26. The upper left side edge 48 and the upper right side edge 52 extend rearwardly from the toe box 56.

A plurality of lacing openings 62, 64 are provided on the upper left side 44 and the upper right side 46. By lacing openings, what is meant is the openings on a shoe upper that are typically occupied by a portion of the lacing that closes the shoe upper over the forefoot opening of the shoe. The lacing openings 62, 64 can be provided by any known means of providing lacing openings on shoes, for example D-rings or speed lacing hooks. However, in the preferred embodiment of the invention, the lacing openings 62, 64 are provided by pluralities of eyelets or grommets 66, 68 on the upper left side 44 and the upper right side 46. The eyelets 66, 68 provide the desired lace up shoe appearance. The eyelet lacing openings 62, 68 are arranged in lines along the upper left side edge 48 and along the upper right side edge 52. As seen in the drawing figures, the lacing openings 62, 64 extend substantially the entire lengths of the upper left side edge 48 and the upper right side edge 52 between the upper collar edge 48 and the upper toe box 56. The novel features of the invention provide the lacing openings 62, 64 on the shoe 12, with there being no lacing positioned in the lacing openings.

The shoe upper 34 includes a vamp 72 or throat positioned rearwardly of the toe box 56, and a tongue 74 that extends rearwardly from the vamp 72. The tongue 74 extends along the lengths of the upper left side 44 and the upper right side 46 to a distal end 76 of the tongue. The tongue 74 has a width between a left side edge 78 and a right side edge 82 of the tongue. The length and width of the tongue position the tongue side edges 78, 82 beneath the upper left side 44 and the upper right side 46 and extend the tongue over the forefoot opening 54 of the shoe. A pair of slots 84, 86 are provided through the tongue. The slots 84, 86 are positioned adjacent the tongue distal end 76 and adjacent the respective left side edge 78 and right side edge 82 of the tongue. The slots 84, 86 pass entirely through the material of the tongue.

Figure 2:
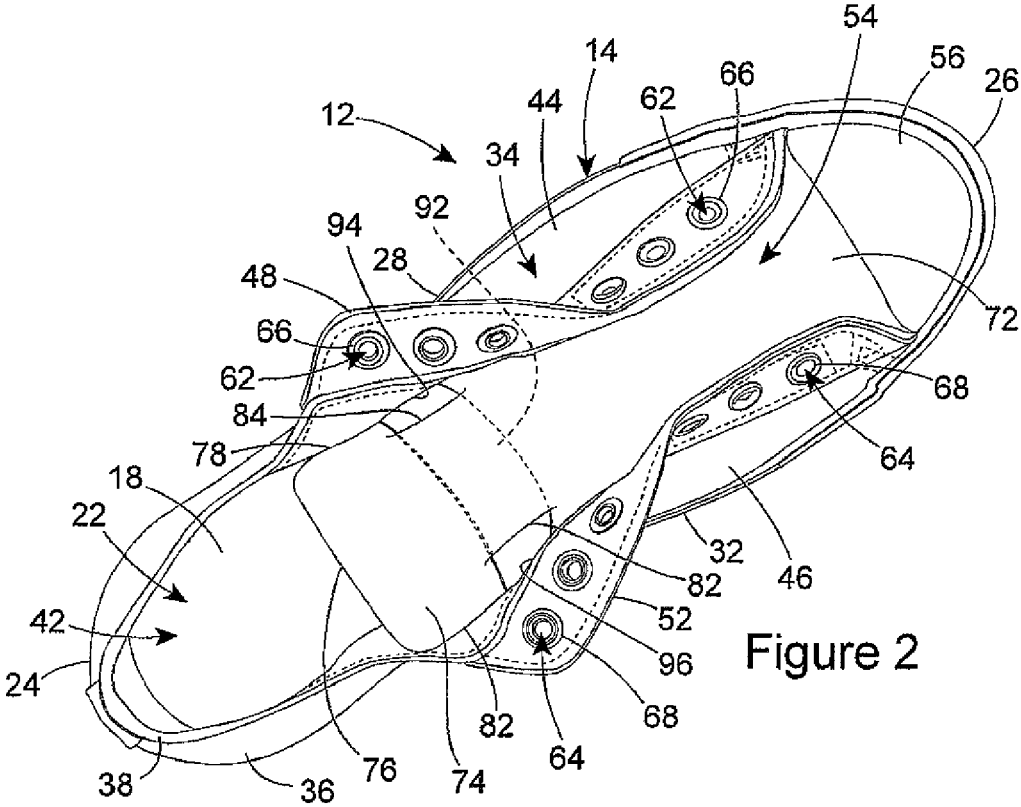
FIG. 2 is a plan view of the shoe of FIG. 1.
Figure 3:
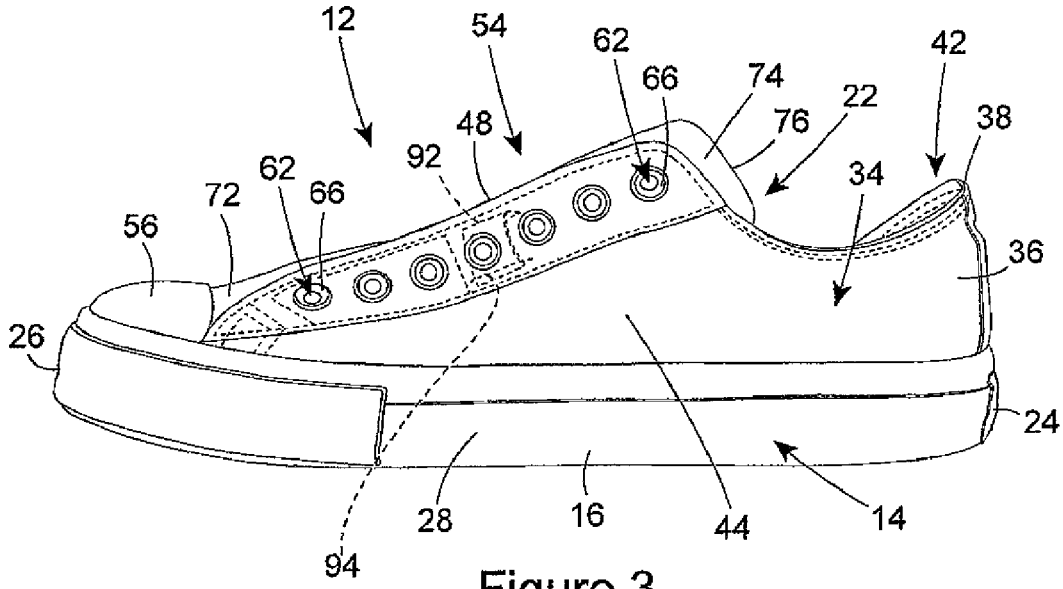
FIG. 3 is a left side elevation view of the shoe of FIG. 1.
Figure 4:
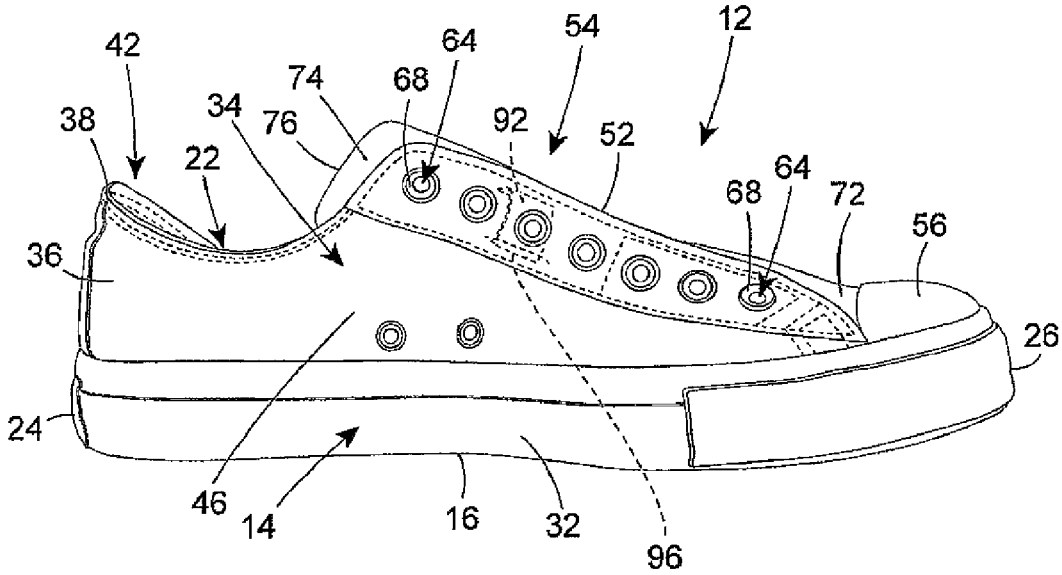
FIG. 4 is a right side elevation view of the shoe of FIG. 1.
Figure 5:
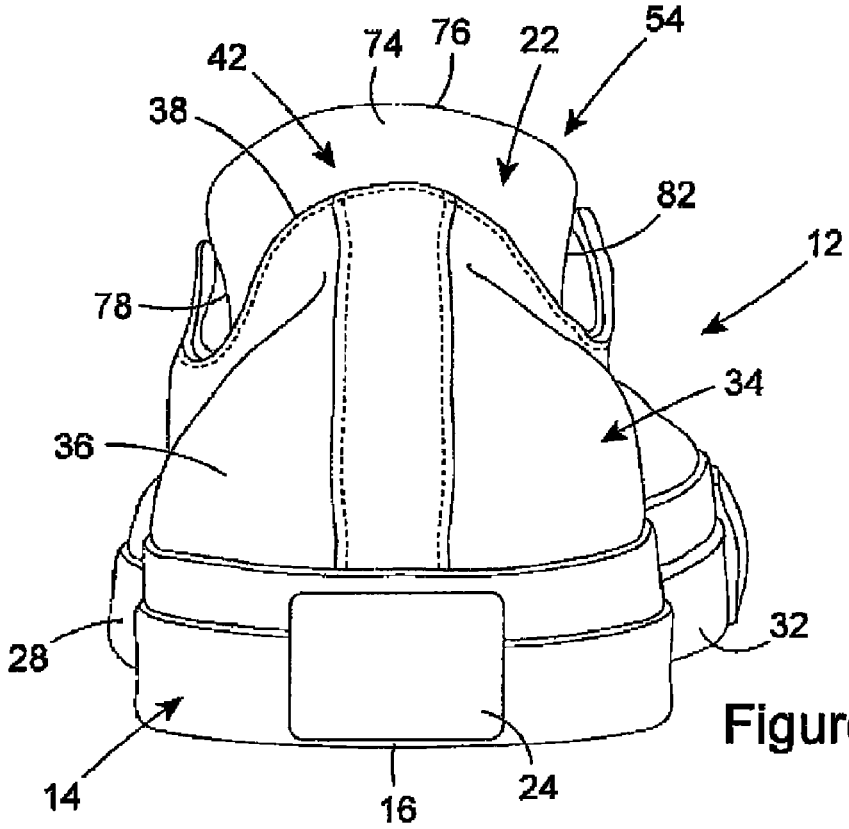
FIG. 5 is a rear elevation view of the shoe of FIG. 1.
Figure 6:
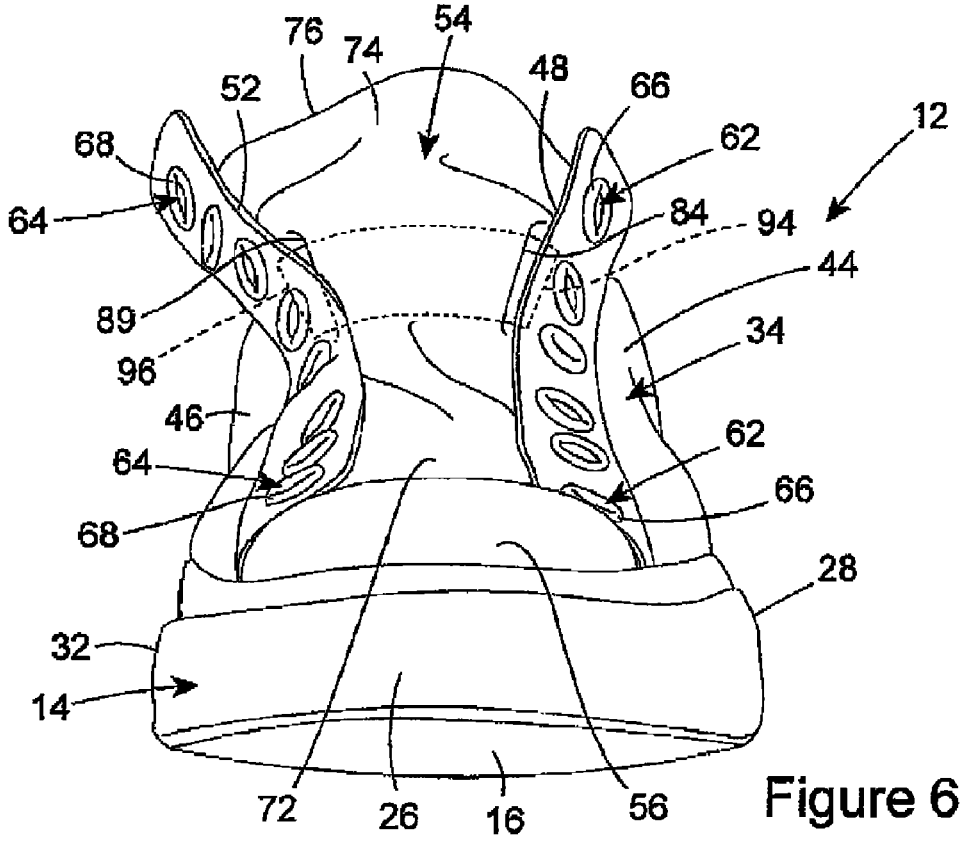
FIG. 6 is a front elevation view of the shoe of FIG. 1.

A thin, narrow band 92 extends across the forefoot opening 54. The band 92 has a left side end 94 that is secured to the upper left side 44, and an opposite right side end 96 that is secured to the upper right side 46. The band left side end 94 is secured to the upper left side 44 in the interior of the shoe, and the band right side end 96 is secured to the upper right side 46 in the interior of the shoe. This conceals the opposite ends of the band 92 from view when the shoe is worn. As the band 92 extends across the forefoot opening 54, the band passes through the slots 84, 86 of the tongue 74. As shown in FIG. 2, a portion of the band adjacent the band left side end 94 extends over the tongue 74 before passing through the left side tongue slot 84, and a portion of the band adjacent the band right side end 96 passes over the tongue 74 before passing through the tongue right side slot 86. The intermediate portion of the band 92 passes beneath the tongue 74 and is covered from view when the shoe is worn. This allows the band 92 to hold the tongue 74 down on the forefront when the shoe is worn, without the band being seen. At least a portion of the band 92 is constructed of an elastic material. In the preferred embodiment of the shoe, the length of the band 92 is elastic.

The elastic feature of the band 92 enables the forefoot opening 54 of the shoe 12 to be enlarged when inserting the foot into the shoe. The shoe wearer merely pulls upwardly on the tongue 74 adjacent the tongue distal end 76 to stretch the band 92 and remove a portion of the tongue from the forefoot opening 54. The shoe wearer then slips their foot into the shoe interior 22 beneath the tongue 74. With the foot inserted in the shoe interior, the tongue 74 is released causing the elastic feature of the band 92 to pull the tongue 74 across the forefoot area of the shoe wearer's foot. The elastic band 92 extending across the forefoot area of the shoe wearers foot just forward of the ankle holds the shoe 12 securely to the foot without the need for lacing.

Thus, the novel construction of the shoe 12 provides a lace up shoe that is securely held to a shoe wearer's foot without the need for lacing, and provides the desired appearance of a lace up shoe that does not have lacing when the shoe is worn.

Although the shoe of the invention has been described above by referring to a particular embodiment of the shoe, it should be understood that modifications and variations could be made to the shoe described without departing from the intended scope of protection provided by the following claims.

The invention claimed is:

1. A shoe comprising:

a shoe sole;

an upper secured to the shoe sole, the upper and the shoe sole together enclosing an interior of the shoe, the upper having a forefoot opening to the interior of the shoe, and the upper having left and right sides that extend along opposite sides of the forefoot opening;

at least one lacing opening arranged along the upper left side and at least one lacing opening arranged along the upper right side; and, a band having a length with opposite left and right ends, the band left end being connected to the upper left side in the interior of the shoe and adjacent the at least one lacing opening arranged along the upper left side and the band right end being connected to the upper right side in the interior of the shoe and adjacent the at least one lacing opening arranged along the upper right side with the band length extending across the forefoot opening, the band positioned forward of an ankle opening of the upper to allow for easy insertion of a wearer's foot into the shoe, the band further configured to securely hold the shoe on the foot, a first portion of the band positioned over a tongue between a left slot and the upper left side, a second portion of the band positioned over the tongue between a right slot and the upper right side, the first and second portions of the band concealed by the upper, and an intermediate portion of the band between the left and right slots concealed by the tongue of the shoe so that the band is not visible when worn by the wearer.

2. The shoe of claim 1, further comprising:

the band being the only connection between the upper left side and the upper right side across the forefoot opening.

3. The shoe of claim 1, further comprising:

portions of the forefoot opening being on opposite sides of the band.

4. The shoe of claim 1, further comprising:

the tongue being connected to the band.

5. The shoe of claim 1, further comprising:

the upper left side having an edge and the upper right side having an edge, the upper left side edge and the upper right side edge opposing each other on opposite sides of the forefoot opening; and, a plurality of lacing openings being arranged in a line along the upper left side edge and being arranged in a line along the upper right side edge.

6. The shoe of claim 5, further comprising:

each lacing opening of the plurality of lacing openings being an eyelet with an opening that extends through the upper.

7. A shoe comprising:

a shoe sole having opposite top and bottom surfaces, a rear heel end and an opposite front toe end, and opposite left and right sides extending along opposite sides of the shoe sole between the heel end and the toe end;

an upper secured to the shoe sole extending upwardly from the shoe sole top surface, the upper having left and right sides that extend along the respective shoe sole left and right sides, the upper left and right sides defining a forefoot opening into the shoe between the upper left and right sides;

at least one lacing opening arranged along the upper left side and at least one lacing opening arranged along the upper right side; and, a band having a length with opposite left and right ends, the band left end being connected to the upper left side inside an interior of the shoe and adjacent the at least one lacing opening and the band right end being connected to the upper right side inside the interior of the shoe and adjacent the at least one lacing opening with the band extending across the forefoot opening, the band positioned forward of an ankle opening of the upper to allow for easy insertion of a wearer's foot into the shoe, the band further configured to securely hold the shoe on the foot, a first portion of the band positioned over a tongue between a left slot and the upper left side, a second portion of the band positioned over the tongue between a right slot and the upper right side, the first and second portions of the band concealed by the upper, and an intermediate portion of the band between the left and right slots concealed by the tongue of the shoe so that the band is not visible when worn by the wearer.

8. The shoe of claim 7, further comprising:

the band being the only connection between the upper left side and the upper right side across the forefoot opening.

9. The shoe of claim 7, further comprising:

at least a portion of the band being elastic.

10. The shoe of claim 9, further comprising:

the band being spaced rearwardly from an upper toe box with portions of the forefoot opening being positioned on opposite sides of the band.

11. The shoe of claim 10, further comprising:

the band having a continuous length with no breaks in the band length between the band left end and the band right end.

12. The shoe of claim 10, further comprising:

the tongue on the shoe upper, the tongue having a length extending rearwardly from the upper toe box and across the forefoot opening between the upper left side and the upper right side; and, at least a portion of the band extending across the tongue.

13. The shoe of claim 12, further comprising:

the tongue having at least one slot in the tongue; and, the band extending through the at least one tongue slot.

14. The shoe of claim 7, further comprising:

the upper left side having an edge and the upper right side having an edge with the forefoot opening being defined between the upper left side edge and the upper right side edge; and a plurality of lacing openings being arranged in a line along the upper left side edge and in a line along the upper right side edge.

15. The shoe of claim 14, further comprising:

each lacing opening of the plurality of lacing openings being an eyelet opening.

16. A shoe comprising:

a shoe sole having opposite top and bottom surfaces, a rear heel end and a front toe end, and opposite left and right sides extending along opposite sides of the shoe sole between the heel end and the toe end;

an upper secured to the shoe sole extending upwardly from the shoe sole top surface and surrounding an interior of the shoe, the upper having a left side and a right side that extend forwardly from the upper heel portion along the respective shoe sole left side and the shoe sole right side and extend upwardly from the shoe sole to a respective upper left side edge and upper right side edge that define a forefoot opening into the upper above the shoe sole top surface, the upper having a tongue with a left slot and a right slot;

at least one lacing opening arranged along the upper left side edge and at least one lacing opening arranged along the upper right side edge, each lacing opening having no lacing positioned in the lacing openings; and, a band having a length with opposite left and right ends, the band left end being secured to the upper left side inside the shoe interior and adjacent the lacing openings and the band right end being secured to the upper right side inside the shoe interior and adjacent the lacing openings with the band length extending across the forefoot opening, the band positioned forward of an ankle opening of the upper to allow for easy insertion of a wearer's foot into the shoe, the band further configured to securely hold the shoe on the foot, a first portion of the band positioned over the tongue between the left slot and the upper left side, a second portion of the band positioned over the tongue between the right slot and the upper right side, the first and second portions of the band concealed by the upper when worn by the wearer without laces, and an intermediate portion of the band between the left and right slots concealed by the tongue of the shoe so that the band is not visible when worn by the wearer without laces.

* * * * *